United States Patent [19]

Thrasher et al.

[11] Patent Number: 4,932,979

[45] Date of Patent: Jun. 12, 1990

[54] METHANOL FUEL MIXTURE

[75] Inventors: Dale A. Thrasher, Costa Mesa; Leonard Greiner, Santa Ana; Gordon Cooper, Encino, all of Calif.

[73] Assignee: XL, Inc., Los Angeles, Calif.

[21] Appl. No.: 326,410

[22] Filed: Mar. 20, 1989

Related U.S. Application Data

[63] Continuation of Ser. No. 90,022, Aug. 27, 1987, abandoned.

[51] Int. Cl.[5] ..... C10L 1/32

[52] U.S. Cl. ..... 44/51; 44/53; 44/59; 44/72; 44/76; 44/79

[58] Field of Search ..... 44/51, 53, 59, 76, 75, 44/77, 72, 79

[56] References Cited

U.S. PATENT DOCUMENTS

| | | | |
|---|---|---|---|
| 46,987 | 3/1865 | Barron | 44/59 |
| 621,338 | 3/1899 | Hempel | 44/53 |
| 2,673,144 | 3/1954 | Huggler | 44/53 |
| 2,988,434 | 6/1961 | Gottshall | 44/53 |
| 3,049,533 | 8/1962 | Spitzer et al. | 44/59 |
| 3,083,224 | 3/1963 | Brace et al. | 558/204 |
| 4,039,301 | 8/1977 | Laity | 44/70 |
| 4,328,003 | 5/1982 | Ryer et al. | 44/53 |
| 4,375,360 | 3/1983 | Washecheck | 44/53 |
| 4,416,667 | 11/1983 | Kaufman et al. | 44/53 |
| 4,534,799 | 8/1985 | Aguirre | 252/332 |
| 4,536,188 | 8/1985 | deWitt | 44/59 |
| 4,539,013 | 9/1985 | Sweeney | 44/68 |

FOREIGN PATENT DOCUMENTS

| | | | |
|---|---|---|---|
| 0127316 | 5/1984 | European Pat. Off. | 44/53 |
| 59-0016990 | 3/1984 | Japan | 44/59 |
| 61-0222981 | 3/1986 | Japan | 44/53 |

*Primary Examiner*—Margaret B. Medley

*Attorney, Agent, or Firm*—Blakely, Sokoloff Taylor, Zafman

[57] ABSTRACT

A high performance methanol fuel is described. In the present invention, the methanol fuel is formulated with approximately 3–15% high purity water, resulting in an aqueous fuel whose properties are independent of subsequent condensation of water from the environment. A low concentration dye, in the range of 0.0005 to 0.0020 weight percent, is utilized to impart color to the liquid fuel. In the preferred embodiment, arazine yellow, manufactured by Chem Serv is utilized, and has no noticable effect on fuel properties. A low concentration of alkali metal salts, such as sodium or lithium carbonate, or a low concentration of alkaline earth salts such as calcium or strontium acetate, in the range of 0.0005 to 0.001 weight percent is utilized as a flame colorant. Improved lubricity of the methanol fuel of the present invention is achieved by utilizing a flourosurfactant of about 0.05 percent by weight. In the preferred embodiment, ZONYL manufactured by DUPONT, is utilized. In order to test the effectiveness of the lubricating additive, a simple test in which an electric motor driven pump is used to maintain a constant flow rate of a fuel containing lubricating agent is performed. By measuring the wattage required to maintain the constant pumping rate for a variety of fuels containing different percentages and different compositions of lubricating agents, meaningful comparisons can be achieved.

7 Claims, No Drawings

METHANOL FUEL MIXTURE

This is a continuation of application Ser. No. 090,022, filed Aug. 27, 1987, now abandoned.

BACKGROUND OF THE INVENTION

1. FIELD OF THE INVENTION

This invention relates to the field of fuels, and in particular, methanol fuels for use in internal combustion engines and turbine engines.

2. BACKGROUND ART

Modern internal combustion engines are high performance systems requiring maximum efficiency, reliability and safety. Materials engineering and mechanical improvements contribute to engine performance, but all engines are dependent in large part on fuel efficiency for performance. Therefore, various high performance fuels have been developed to maximize engine performance. The particular fuel chosen depends on the particular performance requirements of the engine under consideration, economic considerations, and current geopolitical realities.

Alcohol based fuels are popular fuel sources for internal combustion engines. Alcohol based fuels promote energy conservation and environmental protection because they can be produced from self renewing energy sources and because the burning of such alcohol based fuels creates less pollution than results from the burning of hydrocarbon fuels. High performance alcohol based fuels are often the fuel of choice in high end applications, such as in aircraft engines and racing engines.

One such high performance alcohol based fuel is methanol (methyl alcohol, CH30H), well known for clean (complete) combustion. In internal combustion engines, the more completely a fuel burns, the higher the fuel efficiency and ultimately engine efficiency. Thus, methanol is a very efficient fuel. However, there are several disadvantages associated with methanol.

One disadvantage with methanol is the fact that it is colorless in its liquid state. Since a variety of fuels are typically required and available for internal combustion engines, especially in aviation applications, it is necessary to color the fuels to distinguish one from the other. Therefore, it is desireable to have a dye for coloring methanol which does not compromise the performance characteristics of the fuel.

Another disadvantage of methanol as an engine fuel is a colorless flame. Hydrocarbon fuels typically have highly visible flames. However, a methanol flame is almost invisible, resulting in potential hazards. Therefore, it is desireable to provide an additive to methanol which will result in colored flame. In the past, flame colorants utilized with methanol have been solids, such as carbon, certain metal oxides or gasoline or other hydrocarbons, typically in the range of 15 to 50% composition. These additives often produce an emission that interferes with the clean burning of methanol. Therefore, it is desired to produce a flame colorant that does not interfer with the performance characteristics of methanol.

In the past, methanol fuel has been of high purity. There are certain combustion problems associated with the burning of high purity methanol. For example, thermal runaway can occur, where one cylinder overheats and the engine must be shut down. In formulating methanol fuel with added water, increased corrosion to exposed metals may result. Therefore, it is desireable to prevent such corrosion.

Another disadvantage of methanol fuel is a lack of good lubricating characteristics. This lack of lubricity can often cause pump seizures, erosion of ancillary equipment and degrading of moving metal surfaces in close contact. One prior art additive to improve lubricity is castor oil. However, castor oil requires high concentrations to be effective does not have a long life in methanol solution and may cause coatings to build up on engine parts. Further, such additives adversely affect combustion properties of the fuel.

Comparisons between lubricating additives have been difficult to quantify using prior art lubricity tests. In the prior art, fuel containing a lubricating agent is used to coat the surface of a metal piece which is brought into sliding contact with a second metal piece. The metal surface is observed until "pitting" occurs. For fuel such as methanol, pitting occurs in only a few seconds so quantitive comparison for minute differences in concentration of additive are difficult to quantify. This is particularly true since the onset of pitting is somewhat subjective.

SUMMARY OF THE PRESENT INVENTION

A high performance methanol fuel is described. In the present invention, the methanol fuel is formulated with approximately 3–15% high purity water, resulting in an aqueous fuel whose properties are relatively independent of subsequent condensation of water from the environment. A low concentration dye, in the range of 0.0005 to 0.0020 weight percent, is utilized to impart color to the liquid fuel. In the preferred embodiment, arazine yellow, manufactured by Chem Serv, is utilized, and has no noticeable effect on fuel properties. A low concentration of alkali metal salts, such as sodium or lithium carbonate, or a low concentration of alkaline earth salts such as calcium or strontium acetate, in the range of 0.0005 to 0.001 weight percent is utilized as a flame colorant. Improved lubricity of the methanol fuel of the present invention is achieved by utilizing a fluorosurfactant of about 0.01 to 0.05 percent by weight. In the preferred embodiment, ZONYL manufactured by DUPONT, is utilized. In order to test the effectiveness of the lubricating additive, a simple test in which an electric motor driven pump is used to maintain a constant flow rate of a fuel containing lubricating agent is performed. By measuring the wattage required to maintain the constant pumping rate for a variety of fuels containing different percentages and different compositions of lubricating agents, meaningful comparisons can be achieved.

DETAILED DESCRIPTION OF THE PRESENT INVENTION

An improved methanol fuel is described. In the following description, numerous specific details are set forth, such as additive, weight concentration, etc. to provide a more thorough understanding of the present invention. It will be obvious, however, to one skilled in the art, that the present invention may be practiced without these specific details. In other instances, well known features have not been described in detail in order not to unnecessarily obscure the present invention.

As noted previously, the burning of pure methanol can result in minor combustion problems. In order to eliminate combustion problems, the present invention utilizes 3–15% water concentration in the methanol fuel. This concentration is much greater than that expected from subsequent condensation of water from the environment. In this manner, such subsequent condensation does not affect the combustion properties of the fuel.

As might be expected, the use of water in proximity with metal parts, such as an internal combustion engine, can often increase in corrosion. Additives often used to reduce corrosion problems associated with the presence of water in methanol fuel include so called "green soap", phosphates and the like. However, a relatively high concentration of green soap, in the range of 4 to 5 weight percent, is generally required for adequate corrosion protection. Such a high concentration interferes with the desirable fuel characteristics of methanol.

The enhanced corrosion problem caused by water present in methanol fuel is created by impurities present in tap water. Impurities such as chloride ions, iron or copper ions and other metal ions lead to corrosive effects. In order to eliminate the effect of metal ions, the present invention contemplates the use of water additive which has been demineralized to a conductivity of approximately between 0.2 to 1.0 micro-mho/cm. It has been found that when using water of such specification, additional anti-corrosive additives are not required in the methanol fuel. Therefore, the desirable burning properties of the methanol fuel are not affected.

In order to provide a color to the liquid methanol fuel of the present invention, a low concentration dye is added to the fuel. In the preferred embodiment, basic yellow 2 dye, such as ARAZINE YELLOW, manufactured by Chem Serv of Detroit, Mich. is utilized to produce a yellow coloration to the fuel when present in approximatley 0.0005 to 0.002 weight percent. The ARAZINE YELLOW has no effect on the fuel qualities and attributes. Although, in the preferred embodiment, ARAZINE YELLOW is utilized, any dye which imparts color with very low concentration and does not adversely effect the fuel performance characteristics may be utilized.

The fuel of the present invention further includes an additive to impart color to the fuel flame. In the prior art, flame colorants have typically been gasoline and other hydrocarbons. These additives can leave a long lasting emission that interferes with the clean burning of methanol. It is desireable to provide an additive which burns or decomposes to produce a colored flame product, or one which spontaneously attains a pronounced coloration at a moderate temperature. Further, a colorant should not adversely effect fuel properties and should be utilized in low concentrations. In the preferred embodiment of the present invention, it has been found that alkali metals such as sodium and alkaline earth metals such as strontium produces a distinctive orange-red color to methanol flame at moderate temperatures. The metals are too highly reactive to be used as an additive in commercial fuel. So the present invention contemplates the use of alkali salts or alkaline earth salts. In the preferred embodiment, sodium or lithium carbonate, or calcium or strontium acetate, are utilized in an amount of 0.0005 to 0.001 weight percent (equivalent to 0.00025 to 0.0005 weight percent of alkali metal or alkaline earth). The materials used should be of reagent grade.

As noted previously, methanol and methanol/water solutions are poor lubricants. Destructive "seizing" of pumps and other equipment can occur with untreated methanol fuel. The prior art utilizes castor oil to increase the lubricity of methanol fuel However, castor oil percipitates out of solution over time, limiting the shelf life of methanol fuel with a castor oil additive. In addition, relatively high concentrations of castor oil are required, adversely affecting burning properties of the methanol fuel. Further, burning degradation results from the high boiling point of castor oil. The adverse affect on burning properties includes the fouling of spark plugs and plating of a coating on the combuster, requiring expensive engine repair.

Other prior art lubricity additives include esters developed by CONOCO, INC. which also suffer from high boiling temperatures and high concentrations of approximatley 0.5 to 0.75 weight percent.

The present invention utilizes fluorosurfactants as lubricity additives. Flourosurfactants have lower boiling points than prior art additives (in the range of 200 degrees F.) and can be added in very low concentrations (typically approximately 0.05 weight percent). In the preferred embodiment of the present invention, ZONYL FSP manufactured by DUPONT is utilized as a lubricity additive in the methanol fuel of the present invention. ZONYL FSP has the chemical structure $(R_fCH_2CH_2O)_{1,2}P(0)\ (ONH_4)_{2,1}$ where $R_f=F(CF_2CF_2)_{3\text{-}8}$. Fluorosurfactants have long storage life and do not adversely affect the burn properties of the fuel. The action of the surfactant differs from normal additives in that its physical chemistry appears to result in absorption of a molecular layer of stable, highly lubricating material on protected surfaces.

The present invention also provides an improved means and method for testing the effect of lubricity additives to fuel. A noted, prior art methods for determining the effectiveness of a lubricating agent involve measuring the time it takes for pitting to occur in a metal surface in sliding contact with a second piece of metal. This requires expensive and sophisticated test equipment. With all fuels, expensive equipment is required to detect the onset of pitting and provide accurate timing measurements. For methanol fuels, the pitting time is a matter of a few seconds, so quantitive and comparative analysis is difficult, particularly when small concentration differences are compared.

In the method of the present invention, a normal electric motor driven fuel pump is used to pump fuel containing lubricity additives at a constant flow rate. The power in watts drawn by the electric motor to maintain the pumping rate is recorded. The pump is driven with fuels containing various amounts of the same additive so that the optimum amount can be determined. Likewise, fuel is pumped with varying amounts of different additives so that comparison of the power drawn by the electric motor in maintaining the constant flow rate can be used to compare the effectiveness of the various lubricity additives.

Advantages of the present method of performing the lubricity test include standard easily available equipment (electric motors, power meters, etc.), time independence, and "real world" testing conditions. In the preferred embodiment, a piston type pump such as pump C8200-E manufactured by the Weldon Tool Company and driven by motor 8850-5 is employed. However, any similar type pump and motor may be utilized.

In order to isolate friction as a controlling factor in the lubricity testing method of the present invention, a piston type pump should be utilized. In a diaphragm type pump, the power comsumption may be a factor of the viscosity and/or density of the fuel being pumped instead of lubricity. In a piston type pump, when friction is the controlling factor, changes in power comsumption are due to lubricity, and not viscosity.

In order to compensate for operating differences between otherwise identical pumps, the pumps are calibrated by pumping the same fuel composition at a standard rate. In order to diminish the effects of pump aging on power consumption, a pump may be calibrated after each use with a standard fuel composition.

For the fuel of the present invention, the constant flow rate was chosen to be 24 gallons per hour of fuel containing additive. For fuel containing approximately 0.55% castor oil, approximately 14.6 watts were required to maintain the constant flow rate. Fuel having approximately 0.05% ZONYL drew only 13 watts of power to maintain the designated flow rate. Increasing concentration of ZONYL showed an approximately linear decrease in power consumption to approximately 11.4 watts at a concentration of 0.20% ZONYL. In the present invention, ZONYL may be utilized in concentrations ranging from 0.01 to 0.05 weight percent.

The concentration ranges of the respective additives of the present invention are preferred ranges, but do not limit the concentration of such additives. Any suitable concentration may be utilized without departing from the scope of the present invention.

Thus, an improved methanol fuel has been described.

What is claimed is:

1. A fuel composition comprising:

(a) a major portion of fuel comprising 85 to 95% by volume of methanol;

(b) demineralized water, from 3 to 15% of said fuel;

(c) a fluorosurfactant for increasing the lubricity of said fuel, comprising approximately 0.01 to 0.05 weight percent of said fuel.

2. The fuel of claim 1 wherein said water has a conductivity of between approximately 0.2 to 1.0 micromho/cm.

3. The fuel composition of claim 1 further comprising a colorant for adding color to said fuel, from 0.0005 to 0.0002 weight percent of said fuel.

4. The fuel of claim 1 wherein said flourosurfactant comprises $(R_fCH_2CH_2O)_{1,2}P(0)(ONH_4)_{2,1}$ where $R_f=F(CF_2CF_2)_{3\text{-}8}$.

5. A method for improving the lubricity, stability and detectability of methanol fuel comprising the step of adding to methanol water comprising 3 to 15% by volume of said fuel, a colorant comprising basic yellow 2 dye from 0.0005 to 0.002 weight percent for imparting color to said fuel, and fluorosurfactant of approximately 0.01 to 0.05 weight percent for increasing the lubricity of said fuel.

6. The method of claim 5 wherein said water has a conductivity of between approximately 0.2 to 1.0 micromho/cm.

7. The method of claim 5 wherein said fluorosurfactant comprises $(R_fCH_2CH_2O)_{1,2}P(0)(ONH_4)_{2,1}$ where $R_f=F(CF_2CF_2)_{3\text{-}8}$.

* * * * *